US007501177B2

(12) United States Patent
Harada

(10) Patent No.: US 7,501,177 B2
(45) Date of Patent: Mar. 10, 2009

(54) ARTIFICIAL HAIR FIBER BUNDLE AND HAIR DECORATIVE PRODUCT USING THE SAME

(75) Inventor: Satoru Harada, Kakogawa (JP)

(73) Assignee: Kaneka Corporation, Osaka (JP)

( * ) Notice: Subject to any disclaimer, the term of this patent is extended or adjusted under 35 U.S.C. 154(b) by 368 days.

(21) Appl. No.: 10/590,862

(22) PCT Filed: Feb. 18, 2005

(86) PCT No.: PCT/JP2005/002620

§ 371 (c)(1),
(2), (4) Date: Aug. 28, 2006

(87) PCT Pub. No.: WO2005/082184

PCT Pub. Date: Sep. 9, 2005

(65) Prior Publication Data

US 2007/0190322 A1 Aug. 16, 2007

(30) Foreign Application Priority Data

Feb. 27, 2004 (JP) ..... 2004-055594

(51) Int. Cl.
*B32B 19/00* (2006.01)

(52) U.S. Cl. ..... 428/357; 428/364; 428/394; 446/394

(58) Field of Classification Search ..... 428/357, 428/364, 394, 399; 132/53; 446/394
See application file for complete search history.

(56) References Cited

U.S. PATENT DOCUMENTS

| | | | | |
|---|---|---|---|---|
| 3,143,574 | A * | 8/1964 | Brown | 568/26 |
| 3,667,094 | A * | 6/1972 | Yazawa | 28/266 |
| 3,790,434 | A * | 2/1974 | Sone et al. | 428/400 |
| 3,839,081 | A * | 10/1974 | Tanahashi et al. | 442/102 |
| 3,855,382 | A * | 12/1974 | Takeya et al. | 264/178 F |
| 3,953,651 | A * | 4/1976 | Sone et al. | 428/391 |
| 5,083,967 | A | 1/1992 | Yokoe et al. | |
| 5,411,800 | A * | 5/1995 | Yokoe et al. | 428/362 |
| 5,976,693 | A * | 11/1999 | Miyoshi et al. | 428/372 |
| 6,617,024 | B2 * | 9/2003 | Sudo et al. | 428/376 |
| 6,770,364 | B2 * | 8/2004 | Murata et al. | 428/364 |
| 6,821,599 | B1 * | 11/2004 | Kuroda et al. | 428/97 |
| 7,135,225 | B2 * | 11/2006 | Yoshimura et al. | 428/364 |
| 2003/0176563 | A1 * | 9/2003 | Kuroda et al. | 524/497 |
| 2008/0118672 | A1 * | 5/2008 | Kuroda et al. | 428/15 |

FOREIGN PATENT DOCUMENTS

| | | | |
|---|---|---|---|
| JP | 48-44529 | A | 6/1973 |
| JP | 63-290595 | A | 11/1988 |
| JP | 2-53910 | A | 2/1990 |
| JP | 2002-227020 | A | 8/2002 |

OTHER PUBLICATIONS

PCT IPRP and PCT 237 sent by applciant Oct. 31, 2006.*

* cited by examiner

*Primary Examiner*—N. Edwards
(74) *Attorney, Agent, or Firm*—Sughrue Mion, PLLC

(57) ABSTRACT

An artificial hair fiber bundle comprising: a mixture of a synthetic acrylic base fiber (A) made of an acrylic base copolymer containing acrylonitrile, vinyl chloride and vinylidene chloride and a first vinyl monomer copolymerizable therewith, a synthetic acrylic base fiber (B) made of an acrylic base copolymer containing acrylonitrile, vinyl chloride and a second vinyl monomer copolymerizable therewith; a synthetic polyvinyl chloride base fiber having a monofilament fineness of 30 to 90 decitexes, provides a hair decorative product superior in stylability and sensory characteristics and favorable for use as a wig, hairpiece, or the like.

7 Claims, No Drawings

ARTIFICIAL HAIR FIBER BUNDLE AND HAIR DECORATIVE PRODUCT USING THE SAME

TECHNICAL FIELD

The present invention relates to a fiber bundle for use in artificial hair decorative products such as wig, hairpiece, extension-hair (weaving), and hair accessory and a hair decorative product using the same.

BACKGROUND ART

Generally, various fibers such as acrylic base fiber, polyvinyl chloride base fiber, and polyester fiber have been available commercially as artificial hair fibers. However, there were no fiber that could satisfy all characteristics needed as artificial hair fiber such as heat resistance, curling characteristics, touch feeling, and thus, a hair decorative product satisfying the various characteristic could not be obtained only by these fibers in production of a hair decorative product, and products having a characteristic of the fibers each are used in practice.

For example, acrylic base fiber has advantages that it is similar in volume, touch feeling, and brilliance to natural hair and superior in combing smoothness, but also has problems in curling characteristic such as twist of hair bundle by curling, loosening of curled hair over time, and deficiency of elasticity, and thus, has been used mainly for naturally waved hair (no or softly waved hair). In contrast, vinyl chloride fiber has the advantage that it is superior in curling-related characteristics such as tightness of curled hair, resistance to loosening over time, and elasticity when curled spirally, but also has disadvantages such as poor volume and poor sensory characteristics giving touch feeling and brilliance similar to synthetic fiber, and, thus, has been widely used for waved or terminal-curled straight hair.

Thus, for example, various studies on composition of a fiber were made for production of a fiber having the characteristics of both conventional acrylic base fiber and polyvinyl chloride base fiber; and Japanese Unexamined Patent Publication No. 2-53910 proposed a hair fiber superior in cosmetic characteristics that is made of a copolymer containing 15 to 30 wt % of acrylonitrile and 85 to 70 wt % of vinyl chloride, has a H- to dumbbell-shaped cross-sectional shape, and a monofilament fineness of 44 to 78 decitexes; but it has problems that the composition above is likely to produce the copolymer in low heat resistance and a circularity coefficient becomes 1.8 or less due to the H- to dumbbell-shaped cross-sectional shape, and thus soft touch feeling is not obtained due to the rigidity of curled hair. Alternatively, for improvement by mixing of acrylic base fiber and polyvinyl chloride base fiber, Japanese Unexamined Patent Publication 2002-227020 proposed an artificial hair fiber bundle consisting of 20 to 80 wt parts of acrylic base fiber having a monofilament fineness of 30 to 85 decitexes and 20 to 80 wt parts of a vinyl chloride base fiber having a monofilament fineness of 30 to 85 decitexes that can be adopted in a variety range of hair styles without deterioration in the characteristics of both fibers. However, the hair fiber bundle of above composition has various disadvantages in quality since the fiber bundle has simple composition formed of mixture of two kinds of fibers. For example, the hair fiber bundle was insufficient in stylability such as volume and straightness and also in sensory characteristics such as brilliance, combing smoothness and touch feeling, and thus, products modest in quality were only produced.

SUMMARY OF THE INVENTION

An object of the present invention, which was made to overcome the problems above, is to provide an artificial hair fiber bundle for use in wig, hairpiece, extension hair (weaving), hair accessory, and the like that mainly contains an acrylic base fiber having a node-shaped surface irregularity on a fiber surface and having particular ranges of flexural rigidity and torsion rigidity, and a hair decorative product superior in stylability and sensory characteristics.

Accordingly, the present invention relates to an artificial hair fiber bundle, comprising a mixture of: a total amount of 20 to 80 wt parts of a synthetic acrylic base fiber (A) made of an acrylic base copolymer containing 30 to 65 wt % of acrylonitrile, 35 to 70 wt % of vinyl chloride and vinylidene chloride, and 0 to 10 wt % of a first vinyl monomer copolymerizable therewith, and a synthetic acrylic base fiber (B) made of an acrylic base copolymer containing 30 to 65 wt % of acrylonitrile, 35 to 70 wt % of vinyl chloride, and 0 to 10 wt % of a second vinyl monomer copolymerizable therewith; and an amount of 20 to 80 wt parts of a synthetic polyvinyl chloride base fiber having a monofilament fineness of 30 to 90 decitexes.

Preferably, the synthetic acrylic base fiber (A) is made of an acrylic base copolymer containing 40 to 60 wt % of acrylonitrile, 2 to 10 wt % of vinyl chloride, 30 to 60 wt % of vinylidene chloride, and 0 to 10 wt % of the first vinyl monomer copolymerizable therewith.

More preferably, the synthetic acrylic base fiber (A) has surface irregularity on a fiber surface, which has a surface irregularity depth of 5.0 to 15.0 μm and a convex distance of 0.05 to 0.5 mm, and has a flexural rigidity of $7.0\times10^{-7}$ to $10.0\times10^{-7}$ N·m²/m and a torsion rigidity of $5.0\times10^{-9}$ to $10.0\times10^{-9}$ N·m².

Preferably, the synthetic acrylic base fiber (B) is made of an acrylic copolymer containing 40 to 60 wt % of acrylonitrile, 40 to 60 wt % of vinyl chloride, and 0.7 to 8 wt % of the second vinyl monomer copolymerizable therewith.

Further, the hair decorative product according to the present invention is a hair decorative product prepared by using the artificial hair fiber bundle above, and the hair decorative product is preferably a wig, a hairpiece, an extension hair (weaving), a hair accessory, or the like.

By using mainly an acrylic base fiber having surface irregularity on the fiber surface, which has a surface irregularity depth of 5.0 to 15.0 μm and a convex distance of 0.05 to 0.5 mm, and has a flexural rigidity of $7.0\times10^{-7}$ to $10.0\times10^{-7}$ N·m²/m and a torsion rigidity of $5.0\times10^{-9}$ to $10.0\times10^{-9}$ N·m², the artificial hair fiber bundle according to the present invention is superior in stylability and sensory characteristics and thus it is possible to produce a hair decorative product favorable for use in a wig, a hairpiece, an extension hair (weaving), a hair accessory, and the like.

Hereinafter, the present invention will be described in detail.

The present invention relates to an artificial hair fiber bundle comprising a mixture of: a total amount of 20 to 80 wt parts of a synthetic acrylic base fiber (A) made of an acrylic base copolymer containing 30 to 65 wt % of acrylonitrile, 35 to 70 wt % of vinyl chloride and vinylidene chloride, and 0 to 10 wt % of a first vinyl monomer copolymerizable therewith, and a synthetic acrylic base fiber (B) made of an acrylic base copolymer containing 30 to 65 wt % of acrylonitrile, 35 to 70 wt % of vinyl chloride, and 0 to 10 wt % of a second vinyl monomer copolymerizable therewith; and an amount of 20 to 80 wt parts of a synthetic polyvinyl chloride base fiber having a monofilament fineness of 30 to 90 decitexes.

The synthetic acrylic base fiber (A) according to the present invention is made of an acrylic base copolymer containing 30 to 65 wt % of acrylonitrile, 35 to 70 wt % of vinyl chloride and vinylidene chloride, and 0 to 10 wt % of a first vinyl monomer copolymerizable therewith, more preferably from 40 to 60 wt % of acrylonitrile, 2 to 10 wt % of vinyl chloride, 30 to 60 wt % of vinylidene chloride, and 0.7 to 8 wt % of a first vinyl monomer copolymerizable therewith in a total amount of 100 wt %. In the copolymer, an acrylonitrile unit content of less than 30 wt % or a vinyl chloride and vinylidene chloride monomer unit content of more than 70 wt % often leads to insufficient heat resistance. An acrylonitrile unit content of more than 65 wt % or a vinyl chloride and vinylidene chloride monomer unit content of less than 35 wt % often leads to insufficient flame resistance. The copolymerizable first vinyl monomer is a component used, for example, for improvement in dyeing affinity and processability. Examples of the vinyl monomers include acrylic acid, methacrylic acid, the salts and esters thereof, methallylsulfonic acid, styrenesulfonic acid, the salts thereof, acrylamide, vinyl acetate, and the like, and these monomers may be used alone or in combination of two or more.

The synthetic acrylic base fiber (A) according to the present invention has irregularity on the fiber surface. The surface irregularity appears like nodes (regions thin and thick in width present in the length direction of fiber). The depth of surface irregularity (half of the difference in maximum width between neighboring thin and thick regions) is preferably 5.0 to 15.0 μm, more preferably 6.0 to 12.0 μm. The convex distance (distance between neighboring tops of thickened regions) is preferably 0.05 to 0.5 mm, more preferably 0.06 to 0.4 mm. In the case where the surface irregularity depth is less than 5.0 μm, it is hard to obtain desirable stylability; in the case where the surface irregularity depth is more than 15.0 μm, it is likely to give greater roughness on the fiber surface, thereby causing troubles such as breakage of the filament in the wig-producing step. Alternatively, in the case where the convex distance is less than 0.05 mm, it may increase in roughness of the fiber surface, thereby causing troubles such as filament breakage in the wig-producing step. In the case where the convex distance is more than 0.5 mm, it may make it difficult to obtain desirable stylability.

In addition, the flexural rigidity is preferably $7.0\times10^{-7}$ to $10.0\times10^{-7}$ $N\cdot m^2/m$, more preferably $7.0\times10^{-7}$ to $9.0\times10^{-7}$ $N\cdot m^2/m$, and still more preferably $7.5\times10^{-7}$ to $8.5\times10^{-7}$ $N\cdot m^2/m$. The flexural rigidity of less than $7.0\times10^{-7}$ $N\cdot m^2/m$ makes the fiber lower in flexural rigidity and thus, inferior in stylability, while the rigidity of more than $10.0\times10^{-7}N\cdot m^2/m$ may make the touch feeling of fiber harder.

Further, the torsion rigidity is preferably $5.0\times10^{-9}$ to $10.0\times10^{-9}$ $N\cdot m^2$, more preferably $5.0\times10^{-9}$ to $9.6\times10^{-9}$ $N\cdot m^2$, and still more preferably $5.0\times10^{-9}$ to $9.3\times10^{-9}$ $N\cdot m^2$. A torsion rigidity of less than $5.0\times10^{-9}$ $N\cdot m^2$ makes the fiber lower in torsion rigidity and inferior in stylability, while a torsion rigidity of more than $10.0\times10^{-9}N\cdot m^2$ makes the touch feeling of the fiber harder.

As will be described below, the flexural rigidity of the fiber according to the present invention is determined by measuring a flexural moment caused by a repulsive force at each curvature when a synthetic acrylic base fiber is bent in a flexural rigidity analyzer (KES-FB2-S, manufactured by Kato Tech). Alternatively, the torsion rigidity is determined by measuring a torsion moment caused by a repulsive force when a synthetic acrylic base fiber is rotated in a torsion rigidity analyzer (KES-YN1, manufactured by Kato Tech).

The synthetic acrylic base fiber (B) is made of an acrylic base copolymer containing 30 to 65 wt % of acrylonitrile, 35 to 70 wt % of vinyl chloride, and 0 to 10 wt % of a second vinyl monomer copolymerizable therewith, more preferably from 40 to 60 wt % of acrylonitrile, 40 to 60 wt % of vinyl chloride and 0.7 to 8 wt % of a second vinyl monomer copolymerizable therewith in a total amount of 100 wt %. An acrylonitrile unit content in the copolymer of less than 30 wt % or a vinyl chloride monomer unit content of more than 70 wt % leads to insufficient heat resistance. An acrylonitrile unit content of more than 65 wt % or a vinyl chloride monomer unit content of less than 35 wt % may lead to insufficient flame resistance. The copolymerizable second vinyl monomer is a component used, for example, for improvement in dyeing affinity and processability. Examples of the vinyl monomers include acrylic acid, methacrylic acid, the salts and esters thereof, methallylsulfonic acid, styrenesulfonic acid, the salts thereof, acrylamide, vinyl acetate, and the like, and these compounds may be used alone or in combination of two or more.

The method of preparing the acrylic copolymer is not particularly limited, and any one of common vinyl polymerization methods such as suspension polymerization, emulsion polymerization, and solution polymerization may be used.

It is possible to prepare a desirable synthetic acrylic base fiber, by dissolving the acrylic base copolymer described above in acetone or a good solvent of acrylic base copolymer such as dimethylacetamide (hereinafter, referred to as DMAC), dimethylformamide (hereinafter, referred to as DMF), or dimethylsulfoxide (hereinafter, referred to as DMSO) and thus preparing a spinning dope, spinning the dope into a coagulation bath containing an aqueous solution of acetone, DMAC, DMF, DMSO, or the like, and then, processing by a known method.

The monofilament fineness of the synthetic acrylic base fibers (A) or (B) according to the present invention is preferably 20 to 70 decitexes, more preferably 25 to 60 decitexes. The fineness of less than 20 decitexes may lead to problems such as too soft touch feeling and also to poor preservation of curl and wave, which are important factors in styling. The fineness of more than 70 decitexes may lead to very hard touch feeling and impair the stylability as artificial hair.

In addition, a synthetic acrylic base fiber (B) having a fineness of 25 to 40 decitexes and that having a fineness of 40 to 60 decitexes may be used in combination as needed. Favorable examples of the cross-sectional shape of the synthetic acrylic base fiber (A) or (B) include, but are not limited to, hexalobal, horseshoe-shaped, H-shaped, dumbbell-shaped, circular, and the like.

The synthetic polyvinyl chloride base fiber is a fiber prepared from a known polyvinyl chloride homopolymer resin or a known copolymer resin by melt- or dry-spinning, and is not particularly limited. Any one of known copolymer resins may be used as the copolymer resin, and typical examples thereof include copolymer resins such as vinyl chloride-vinyl acetate copolymer resins, vinyl chloride-vinyl ester copolymer resins, vinyl chloride-acrylic ester copolymer resins, and vinyl chloride-olefin copolymer resins such as vinyl chloride-ethylene copolymer resins, and the like.

The monofilament fineness of the synthetic polyvinyl chloride base fiber according to the present invention is preferably 30 to 90 decitexes, more preferably 50 to 80 decitexes. Favorable examples of the cross-sectional shape of the synthetic polyvinyl chloride fiber include, but are not limited to, circular, star-shaped, dumbbell-shaped, binocular-shaped, and the like.

The mixing ratio of the synthetic acrylic base fibers (A) and (B) to the synthetic polyvinyl chloride base fiber is selected properly according to the requirements in quality of various styles, but the total content of the synthetic acrylic base fibers (A) and (B) is preferably 20 to 80 wt parts; and more preferably, the fiber (A) is contained in an amount of 10 to 50 wt parts, the fiber (B) of 10 to 70 wt parts, and the synthetic polyvinyl chloride fiber of 20 to 80 wt parts. More preferably, the total amount of the synthetic acrylic base fibers (A) and (B) is 30 to 75 wt parts; and the range of the fiber (A) is 15 to 40 wt parts; the fiber (B), 15 to 60 wt parts; and the synthetic polyvinyl chloride fiber, 25 to 70 wt parts.

Further, in the fiber (B) above, fibers different in fineness are preferably used with various mixing ratios. More preferably, the content of the synthetic acrylic base fiber (B) having a fineness of 25 to 40 decitexes is less than 20 wt parts.

The synthetic polyvinyl chloride base fiber content of less than 20 wt parts may lead to deterioration in the strength of curled hair and thus in stylability, while the content of more than 80 wt parts to deterioration in volume and also in sensory characteristics.

The method of mixing the synthetic acrylic base fibers (A) and (B) with the synthetic polyvinyl chloride base fiber is not particularly limited if they are mixed uniformly, and any one of known methods such as hackling may be used in mixing.

On the other hand, the hair decorative product according to the present invention is a hair decorative product using the artificial hair fiber bundle, and favorable examples of the hair decorative products include wig, hairpiece, extension hair (weaving), hair accessory, and the like.

Any one of known manufacturing methods may be used as the method of producing such a hair decorative product by using the artificial hair fiber bundle according to the present invention. For example, in preparing a wig, a fiber bundle is thoroughly mixed by hackling and sewn by using a sewing machine for wig into a weft; the hair is then curled in heat-treatment as it is wound around a pipe, giving a curled weft, which is then sewn on a hair cap and styled.

BEST MODE OF CARRYING OUT THE INVENTION

Hereinafter, the present invention will be described specifically with reference to Examples, but it should be understood that the present invention is not restricted thereby.

EXAMPLES

Test and evaluation methods used in the following Examples will be described in detail.

In the Examples, "part" and "%" mean respectively wt parts and wt %, unless otherwise specified.

(Measurement of Surface Irregularity)

The surface irregularity depth and the convex distance were determined by taking a micrograph of the side face of a fiber under an optical microscope at a magnification of 100 times, measuring the fiber widths (maximum widths) of the fiber in the thick regions and thin regions, and then, calculating them according to the following conditions.

Surface Irregularity Depth:

The measurements were performed at 30 points, and the average of the results was calculated.

$$\text{Surface Irregularity Depth } (H)=(H1-H2)\times\tfrac{1}{2}$$

(H1: fiber width in thick region, H2: fiber width in thin region)

Convex Distance:

The distances between neighboring tops of thick regions were determined at 30 points, and the average of the results was calculated.

(Method of Measuring Flexural Rigidity)

The flexural rigidity (unit: $N\cdot m^2/m$) was determined in a flexural rigidity analyzer (KES-FB-S, manufactured by Kato Tech), by preparing a sample of a bundle of 49 acrylic filaments having a length of 1 cm that are placed in line at an interval 1 mm, measuring the flexural rigidity thrice under the condition of a bending curvature of ±2.5 cm, and calculating the average thereof.

(Method of Measuring Torsion Rigidity)

The torsion rigidity (unit: $N\cdot m^2$) was determined in a torsion rigidity analyzer (KES-YN1, manufactured by Kato Tech), by measuring the torsion rigidity of a sample of 2 cm in length under the condition of giving a twist number of rotations of ±3 revolutions with a torsion speed of 12 degree/second, and obtaining the average of the results in ten measurements.

(Method of Evaluating Stylability)

In evaluating the stylability, a fiber bundle was sewn with a sewing machine for wig into a weft with filaments having a length of 25 cm, and the weft was then heat-set in a convectional-type drier at 110° C. for 1 hour as it is wound around a pipe having a diameter of 35 mm, giving a curled weft. The curled weft was sewn on a net in 10 rows at an interval of 1 cm, and the curl retention stability, hair-curling adaptability, and volume, straightness (hair alignment) of the resulting wig were ranked respectively in five tiers, immediately, 1 day, and 7 days after sewing, by five normal technicians engaged in evaluation of hair decorative products such as a wig. A wig rated four points or more in all test items is regarded as satisfactory.

Evaluation Criteria:

5: very good, 4: good, 3: average, 2: bad, and 1: very bad.

(Method of Measuring Sensory Characteristics)

In evaluating the sensory characteristics, a fiber bundle was sewn by using a sewing machine for wig into a weft with filaments having a length of 25 cm; the weft was heat-set and curled as wound around a pipe having a diameter of 10 to 40 mm in a convectional-type drier at 110° C. for 1 hour. The curled weft was sewn onto a cap, to give short- and long-haired wigs in two kinds of styles, straight and curl; and the brilliance, combing smoothness, and touch feeling thereof were ranked respectively in five tiers, immediately, 1 day, and 7 days after sewing, by five normal technicians engaged in evaluation of hair decorative products such as wig. A wig rated four points or more in all test items is regarded as satisfactory.

Evaluation Criteria:

5: very good, 4: good, 3: average, 2: bad, and 1: very bad

Preparative Example 1

[Preparation of Synthetic Acrylic Base Fiber (A)]

An acrylic base copolymer resin containing 52% of acrylonitrile, 4% of vinyl chloride, 42.6% of vinylidene chloride, and 1.4% of sodium styrenesulfonate was dissolved in acetone, to give a 26% spinning dope. The viscosity of the spinning dope was 50 poises. The dope was extruded through a * -type profile nozzle into an aqueous 35% acetone solution at 20° C. under the condition of a nozzle draft of 0.8; the fiber thus obtained was washed in a water-washing bath at 50° C. for removal of the solvent, drawn 1.9 times, dried at a drying temperature 125° C. and a wet-bulb temperature 75° C., drawn twice under a dry heat condition at 135° C., and relaxed under a dry heat condition at 160° C. The monofilament fineness of the acrylic base fiber thus obtained was 51 decitexes. The cross-sectional shape is almost circular; the filament had a node-shaped surface irregularity; and the surface irregularity depth was 7.0 μm and the convex distance was 0.25 mm. In addition, the flexural rigidity was $7.5\times10^{-7}$ N−m$^2$/m, and the torsion rigidity was $5.0\times10^{-9}$ N·m$^2$.

Preparative Example 2

[Preparation of Synthetic Acrylic Base Fiber (B)]

An acrylic base copolymer resin containing 50% of acrylonitrile, 49% of vinyl chloride, and 1% of sodium styrenesulfonate was dissolved in acetone, to give a 29% spinning dope. The dope was extruded through a dumbbell-shaped profile nozzle into an aqueous 20% acetone solution at 20° C. under the condition of a nozzle draft of 1.6; the fiber obtained was washed in a water-washing bath at 50° C. for removal of the solvent, drawn 1.5 times, dried at a drying temperature 130° C., drawn 2.5 times under a dry heat condition at 125° C., and relaxed under a dry heat condition at 150° C. The monofilament fineness of the acrylic base fiber thus obtained was 47 decitexes. The crosssectional shape was almost H-shaped.

Preparative Example 3

[Preparation of Synthetic Acrylic Base Fiber (B)]

An acrylic base copolymer resin containing 50% of acrylonitrile, 49% of vinyl chloride, and 1% of sodium styrenesulfonate was dissolved in acetone, to give a 29% spinning dope. The dope was extruded through 0.2 mmϕ nozzle into an aqueous 20% acetone solution at 20° C. under the condition of a nozzle draft of 1.0; the fiber obtained was washed in a water-washing bath at 50° C. for removal of the solvent, drawn 1.5 times, dried at a drying temperature 130° C., drawn 2.5 times under a dry heat condition at 125° C., and relaxed under a dry heat condition at 150° C. The monofilament fineness of the acrylic base fiber thus obtained was 27 decitexes. The cross-sectional shape was almost horseshoe-shaped.

Preparative Example 4

[Preparation of Synthetic Polyvinyl Chloride Base Fiber]

100 parts of a polyvinyl chloride resin (polymerization degree: 1000), 3 parts of epoxidized soy bean oil, 1.5 parts of a tin-base stabilizer, 3 parts of a lubricant having a saponification value of 10 or more, and 0.8 parts of a lubricant having a saponification value of 10 or less were mixed and stirred in a ribbon blender at 110° C. for 40 minutes; the mixture was then pelletized by means of an extruder at a cylinder temperature of 140° C. and a dice temperature of 145° C. A binocular-shaped nozzle having an effective hole size of 0.5 mmϕ was connected to a 30 mmϕ extruder (L/D=20), and the resin pellets were extruded through the nozzle by the extruder at a cylinder temperature in the range of 150 to 180° C. and a nozzle temperature of 180±15° C.; and the resulting filament was heat-treated in a heated spinning cylinder (in an atmosphere at 200 to 300° C.) immediately below the nozzle for approximately 0.5 to 1.5 seconds, before it is wound around a first winding roll. The filament was then drawn 2.5 times between the first winding roll and a second drawing roll in a hot air-circulating chamber at 110° C. The filament was then relaxed under a dry heat condition by 25% continuously while it is stretched between two pairs of conical rolls placed in a chamber at a controlled temperature of 115° C., to give a fiber having a monofilament fineness of 62 decitexes.

Examples 1 to 4 and Comparative Examples 1 to 4

The acrylic base fibers prepared in Preparative Examples 1, 2, and 3 and the vinyl chloride base fiber prepared in Preparative Example 4 were mixed during hackling respectively at the ratios shown in Table 1, to give fiber bundles.

[Table 1]

TABLE 1

| | Mixing ratio of fiber bundle (wt parts) | | | |
|---|---|---|---|---|
| | Fiber in Preparative Example 1 51 dtex | Fiber in Preparative Example 2 47 dtex | Fiber in Preparative Example 3 27 dtex | Fiber in Preparative Example 4 78 dtex |
| Example 1 | 20 | 50 | | 30 |
| 2 | 20 | 30 | 10 | 40 |
| 3 | 30 | 20 | 10 | 40 |
| 4 | 30 | | 10 | 60 |
| Comparative Example 1 | 100 | | | |
| 2 | 40 | | | 60 |
| 3 | | 50 | | 50 |
| 4 | | | | 100 |

Then, each of these fiber bundles was sewn by using a sewing machine for wig into a weft with filaments having a length of 25 cm; the weft was heat-set and curled, as wound around a pipe having a diameter of 35 mm in a convectional-type drier at 110° C. for 1 hour. The curled weft was sewn onto a net in 10 rows at an interval of 1 cm. The stylability tests thereof, specifically of hair curl retention, curl stability, volume, and straightness (hair alignment), were performed, and the results are summarized in Table 2.

[Table 2]

TABLE 2

| | Stylability evaluation results | | | | |
|---|---|---|---|---|---|
| | Hair curl retention | Hair-curling adaptability | Volume | Straightness | Overall rating |
| Example 1 | 4 | 4 | 5 | 4 | (Satisfactory) |
| 2 | 4 | 5 | 5 | 5 | (Satisfactory) |
| 3 | 4 | 5 | 5 | 5 | (Satisfactory) |
| 4 | 5 | 4 | 4 | 5 | (Satisfactory) |
| Comparative Example 1 | 3 | 3 | 4 | 4 | (Unsatisfactory) |
| 2 | 5 | 3 | 3 | 5 | (Unsatisfactory) |
| 3 | 3 | 2 | 3 | 3 | (Unsatisfactory) |
| 4 | 3 | 2 | 2 | 5 | (Unsatisfactory) |

Separately, each of these fiber bundles was sewn by using a sewing machine for wig into a weft with filaments having a length of 25 cm; the weft was heat-set and curled as wound around a pipe having a diameter of 10 to 40 mm in convectional-type drier at 110° C. for 1 hour. The curled weft was sewn onto a cap, to give short- and long-haired wigs into two kinds of styles, straight and curly. The sensory characteristics thereof such as brilliance, combining smoothness, and touch feeling were evaluated, and the results are summarized in Table 3.

[Table 3]

TABLE 3

| | Sensory characteristics evaluation results | | | |
|---|---|---|---|---|
| | Brilliance | Combing smoothness | Touch feeling | Overall rating |
| Example 1 | 4 | 4 | 4 | 4 (Satisfactory) |
| 2 | 5 | 5 | 5 | 5 (Satisfactory) |
| 3 | 4 | 5 | 5 | 5 (Satisfactory) |
| 4 | 4 | 4 | 4 | 4 (Satisfactory) |
| Comparative Example 1 | 3 | 2 | 2 | 3 (Unsatisfactory) |
| 2 | 3 | 3 | 3 | 3 (Unsatisfactory) |
| 3 | 3 | 3 | 3 | 2 (Unsatisfactory) |
| 4 | 3 | 2 | 2 | 2 (Unsatisfactory) |

The results in Table 2 show that it is possible to improve insufficiency in volume, a disadvantage of synthetic polyvinyl chloride base fiber, and to improve hair-curling adaptability and hair curl retention, disadvantages of synthetic acrylic base fiber, at the same time by mixing the synthetic acrylic base fibers (A) and (B) with the synthetic polyvinyl chloride base fiber at a particular ratio, and that the resulting wig is applicable to any kind of styles.

The results in Table 3 show that it is possible to improve touch feeling and reduce synthetic fiber-like brilliance, disadvantages of synthetic polyvinyl chloride, in hair decorative products in a wide range of hair styles and to prevent deterioration in curling characteristics and thus improve combing smoothness, disadvantages of synthetic acrylic base fiber, by mixing the synthetic acrylic base fibers (A) and (B) with the synthetic polyvinyl chloride fiber at a particular ratio, and thus, to produce hair decorative products having superior sensory characteristics.

The invention claimed is:

1. An artificial hair fiber bundle, comprising a mixture of:

a total amount of 20 to 80 wt parts of a synthetic acrylic base fiber (A) made of an acrylic base copolymer containing 30 to 65 wt % of acrylonitrile, 35 to 70 wt % of vinyl chloride and vinylidene chloride, and 0 to 10 wt % of a first vinyl monomer copolymerizable therewith, and a synthetic acrylic base fiber (B) made of an acrylic base copolymer containing 30 to 65 wt % of acrylonitrile, 35 to 70 wt % of vinyl chloride, and 0 to 10 wt % of a second vinyl monomer copolymerizable therewith; and an amount of 20 to 80 wt parts of a synthetic polyvinyl chloride base fiber having a monofilament fineness of 30 to 90 decitexes.

2. The artificial hair fiber bundle according to claim 1, wherein the synthetic acrylic base fiber (A) is made of an acrylic base copolymer containing 40 to 60 wt % of acrylonitrile, 2 to 10 wt % of vinyl chloride, 30 to 60 wt % of vinylidene chloride, and 0.7 to 8 wt % of the first vinyl monomer copolymerizable therewith.

3. The artificial hair fiber bundle according to claim 1, wherein the synthetic acrylic base fiber (A) has surface irregularity on a fiber surface, which has a surface irregularity depth of 5.0 to 15.0 μm and a convex distance of 0.05 to 0.5 mm, and has a flexural rigidity of $7.0\times10^{-7}$ to $10.0\times10^{-7}$ $N\cdot m^2/m$ and a torsion rigidity of $5.0\times10^{-9}$ to $10.0\times10^{-9}$ $N\cdot m^2$.

4. The artificial hair fiber bundle according to claim 1, wherein the synthetic acrylic base fiber (A) has a monofilament fineness of 20 to 70 decitexes and is mixed in the fiber bundle in an amount of 10 to 50 wt parts.

5. The artificial hair fiber bundle according to claim 1, wherein the synthetic acrylic base fiber (B) is made of an acrylic base copolymer containing 40 to 60 wt % of acrylonitrile, 40 to 60 wt % of vinyl chloride, and 0.7 to 8 wt % of the second vinyl monomer copolymerizable therewith.

6. The artificial hair fiber bundle according to claim 1, wherein the synthetic acrylic base fiber (B) has a monofilament fineness of 20 to 70 decitexes and is mixed in the fiber bundle in an amount of 10 to 70 wt parts.

7. A hair decorative product, comprising the artificial hair fiber bundle according to claim 1.

* * * * *

US007501177C1

(12) EX PARTE REEXAMINATION CERTIFICATE (8006th)

United States Patent

Harada

(10) Number: US 7,501,177 C1

(45) Certificate Issued: Jan. 25, 2011

(54) ARTIFICIAL HAIR FIBER BUNDLE AND HAIR DECORATIVE PRODUCT USING THE SAME

(75) Inventor: Satoru Harada, Kakogawa (JP)

(73) Assignee: Kaneka Corporation, Kita-Ku, Osaka-Shi, Osaka (JP)

Reexamination Request:
No. 90/010,839, Jan. 29, 2010

Reexamination Certificate for:

| | |
|---|---|
| Patent No.: | **7,501,177** |
| Issued: | **Mar. 10, 2009** |
| Appl. No.: | **10/590,862** |
| Filed: | **Aug. 28, 2006** |

(22) PCT Filed: Feb. 18, 2005

(86) PCT No.: PCT/JP2005/002620

§ 371 (c)(1), (2), (4) Date: Aug. 28, 2006

(87) PCT Pub. No.: WO2005/082184

PCT Pub. Date: Sep. 9, 2005

(51) Int. Cl.
*B32B 19/00* (2006.01)

(52) U.S. Cl. ..... 428/357; 428/357; 428/364; 428/394; 446/394

(58) Field of Classification Search ..... 428/357
See application file for complete search history.

(56) References Cited

FOREIGN PATENT DOCUMENTS

| | | |
|---|---|---|
| JP | U S48-007288 | 1/1973 |
| JP | 2001-064817 | 3/2001 |
| JP | 2002-227020 | 8/2002 |
| WO | WO 2004/013389 | 2/2004 |

*Primary Examiner*—Stephen J Stein

(57) ABSTRACT

An artificial hair fiber bundle comprising: a mixture of a synthetic acrylic base fiber (A) made of an acrylic base copolymer containing acrylonitrile, vinyl chloride and vinylidene chloride and a first vinyl monomer copolymerizable therewith, a synthetic acrylic base fiber (B) made of an acrylic base copolymer containing acrylonitrile, vinyl chloride and a second vinyl monomer copolymerizable therewith; a synthetic polyvinyl chloride base fiber having a monofilament fineness of 30 to 90 decitexes, provides a hair decorative product superior in stylability and sensory characteristics and favorable for use as a wig, hairpiece, or the like.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *